US011401670B2

(12) United States Patent
Teixeira Goethel

(10) Patent No.: US 11,401,670 B2
(45) Date of Patent: Aug. 2, 2022

(54) SELF-PROPELLED EQUIPMENT FOR STREET SWEEPING AND/OR WEEDING

(71) Applicant: Enilton Teixeira Goethel, Teutônia (BR)

(72) Inventor: Enilton Teixeira Goethel, Teutônia (BR)

( * ) Notice: Subject to any disclaimer, the term of this patent is extended or adjusted under 35 U.S.C. 154(b) by 895 days.

(21) Appl. No.: 16/228,126

(22) Filed: Dec. 20, 2018

(65) Prior Publication Data

US 2019/0218732 A1 Jul. 18, 2019

(30) Foreign Application Priority Data

Dec. 20, 2017 (BR) ..... 20 2017 027655 0

(51) Int. Cl.

| | |
|---|---|
| ***E01H 1/08*** | (2006.01) |
| ***B08B 1/00*** | (2006.01) |
| ***B08B 1/04*** | (2006.01) |
| ***A46B 13/00*** | (2006.01) |
| ***A46B 13/02*** | (2006.01) |
| ***B08B 5/04*** | (2006.01) |

(52) U.S. Cl.

CPC ..... *E01H 1/0845* (2013.01); *A46B 13/008* (2013.01); *A46B 13/02* (2013.01); *B08B 1/002* (2013.01); *B08B 1/04* (2013.01); *B08B 5/04* (2013.01); *E01H 1/0827* (2013.01); *A46B 2200/3066* (2013.01); *E01H 2001/0881* (2013.01)

(58) Field of Classification Search

CPC ... E01H 1/0845; E01H 1/0827; E01H 1/0836; E01H 1/053; E01H 1/056; E01H 2001/0881; A46B 13/008; A46B 13/02; A46B 2200/3066; B08B 1/002; B08B 1/04; B08B 5/04

USPC ..... 15/340.1

See application file for complete search history.

(56) References Cited

U.S. PATENT DOCUMENTS

| | | | | |
|---|---|---|---|---|
| 2,937,713 A | | 5/1960 | Stephenson et al. | |
| 4,368,554 A | * | 1/1983 | Mealing | E01H 1/056 15/385 |
| 4,414,699 A | | 11/1983 | Hirt | |
| 4,655,468 A | * | 4/1987 | Cunningham | B62D 25/168 280/851 |
| 4,754,521 A | * | 7/1988 | Zoni | E01H 1/0854 15/348 |

(Continued)

FOREIGN PATENT DOCUMENTS

| | | |
|---|---|---|
| BR | PI 9503391-2 A | 9/1997 |
| BR | 10 2014 003910-4 A2 | 12/2015 |

(Continued)

*Primary Examiner* — Joseph J Hail

*Assistant Examiner* — Caleb Andrew Holizna

(74) *Attorney, Agent, or Firm* — Eugenio J. Torres-Oyola; Victor M. Rodriguez-Reys; Rafael Rodriguez-Muriel

(57) ABSTRACT

Disclosed is self-propelled equipment for street sweeping and/or weeding, where modifications were made to the cleaning system of the filters, the battery for driving the motors with electric start, front fairing assembly over the turbine, combustion or electric motor, debris suction pipe, hydraulic components, headlights, motor protection and brooms and motors for each front wheel and telescopic brooms that will act at a 180° angle by sweeping away debris from the sidewalk or even from the street ahead of the main brooms.

1 Claim, 11 Drawing Sheets

(56) References Cited

U.S. PATENT DOCUMENTS

| | | | | |
|---|---|---|---|---|
| 4,884,313 | A * | 12/1989 | Zoni | E01H 1/042 15/348 |
| 5,383,246 | A * | 1/1995 | Hagen | E01H 1/045 15/83 |
| 6,195,837 | B1 * | 3/2001 | Vanderlinden | E01H 1/0854 15/348 |
| 2004/0020003 | A1 * | 2/2004 | Strauser | E01H 1/0845 15/340.3 |
| 2007/0187075 | A1 * | 8/2007 | Yamada | F01P 11/10 165/135 |
| 2014/0102301 | A1 * | 4/2014 | Marks | E21B 43/26 95/280 |
| 2017/0197550 | A1 * | 7/2017 | Navarro Zavala | B60Q 1/302 |
| 2017/0247846 | A1 * | 8/2017 | Song | E01H 1/0836 |

FOREIGN PATENT DOCUMENTS

| | | | |
|---|---|---|---|
| BR | 10 2015 025596-9 | A2 | 5/2017 |
| EP | 1 707 678 | A2 | 10/2006 |

* cited by examiner

SELF-PROPELLED EQUIPMENT FOR STREET SWEEPING AND/OR WEEDING

TECHNICAL FIELD

The following specification for utility model refers to the development of self-propelled equipment for street sweeping and/or weeding, enabling the extraction, separation of larger residues and filtering of smaller particles of dust from the air entering through the waste pick-up and that will be expelled by the turbine to the environment, counting on a propulsion system, through a combustion or electric motor, motors and hydraulic components, cabin and closed fairing assembly to guarantee a greater safety and comfort to the operator, besides protecting the components system, as well as isolating them from public access.

STATE OF THE ART

Several urban vacuum cleaners have been located, whether they are used in the aspiration of leaves or the aspiration of waste, such as papers, small solids, cigarette stubs, etc. Self-propelled vehicles that make the sweeping, weeding and aspiration of the streets are also known.

Patent documents U.S. Pat. Nos. 2,937,713; 4,414,699 and EP 1,707,678 disclose automatic street sweeping devices consisting of a truck provided with suction combined with circular brooms disposed close to the floor, the suction acting in partnership with the brooms, so that the vacuum established by the truck collect the dirt swept by the said circular brooms. The dirt that has been swept and sucked into the truck is stored in an internal tank to be disposed of in an appropriate location. In this same line of equipment there is the BR 10 2015 025596-9 which discloses a public road sweeper with four sweeping brushes on both sides of the vehicle, two front brushes of them can be extended and increase sweep width, which becomes well suited for cleaning guides and highway median strip. It comprises the chassis, the sub-engine, the sweeping device of the four sweeping discs, the subframe, the winding mechanism assembly, the working hydraulics, the suction disc and other apparatus where the chassis supports operational driving power, which includes all movement to the front or back of the vehicle, braking or acceleration. The sub-motor generates energy for rotation of the sweeping disk and wind mechanism, sweeping disk and suction nozzle motion, waste bin elevation, rear port opening and hydraulic pump transmission.

Other devices used for street sweeping are less powerful than a truck with suction. These smaller equipment may be self-propelled as in the case of PI 9503391-2 which discloses a street cleaning machine which in only one assembly has the function of sweeping and collecting dust and debris on the streets with due bagging, simultaneously, being constituted of a self-propelled assembly by stationary motor, clutch assembly equipped with pulleys that drive the gear box with the cyclone through flexible tubes. Said cyclone is closed by latches and is supported by a rotating support. The assembly is also constituted by a collecting hood that sucks the waste and directs them to the cyclone. Cardam and differential are part of the assembly which are driven by the gear box and draw the wheels causing the equipment to move along the stretch to be worked. Are further part of the assembly a bag support drawer that is attached to the chassis, being supported on 03 wheels, one front wheel with free wheel and crank with the same height of the brooms, and a clutch drive lever and steering control.

A self-propelled sweeping equipment is further described in BR 10 2014 003910-4, intended for weeding, sweeping and scraping with automatic waste collection, using brushes positioned one on the right side and one on the left side, which work in conjunction with the brushes of the front articulated arm, actuated jointly or individually with the lower manifold pipes interconnected by piping directly to the interior of the removable collection bag, by means of an articulated crane driven by the compression or electric hydraulic system.

TECHNICAL PROBLEMS

Self-propelled equipment described in U.S. Pat. Nos. 2,937,713; 4,414,699 and EP 1,707,678, are large vehicles which perform the sweeping, suction and cleaning of the air which is demanded back into the environment. However, these vehicles are expensive as they are mounted on a truck chassis. This same problem occurs with the BR 10 2015 025596-9, which discloses a truck for sweeping and cleaning streets. Less expensive and complex than these documents is the device PI 9503391-2 that shows a smaller self-propelled vehicle which nevertheless efficiently sweeps the streets.

Document BR 10 2014 003910-4 discloses a self-propelled trolley, but which has neither a closed cabin nor a fairing assembly.

PROPOSED SOLUTION

Thus, due to the considerations pertinent to the state of the art discussed above and in order to present a self-propelled equipment for street sweeping and/or weeding, the present utility model is proposed, where modifications were made to the cleaning system of the filters, battery for motors with electric start, front fairing assembly on the turbine, combustion or electric motor, debris suction, hydraulic components, headlights, motor protection and brooms and motors for each front wheel. In addition, telescopic brooms have been introduced that will act at a 180° angle by sweeping away debris from the sidewalk or even from the street ahead of the main brooms. These brooms are attached to the fixed chassis, driven by hydraulic and or electric motors. The equipment has a display in the door of the waste collector, a larger fixed chassis with the rear wheels movable, articulated by a hydraulic cylinder. It further has a cabin that contains in its lower part, the hydraulic oil tank, radiator, hydraulic oil cooler, front, windshield, in its front part, rear window, as well as the lights on the sides of the doors, with glass and mirrors and inside the operator seat. In the steering, a priority valve is attached and all controls are arranged on the panel, on the floor, the pedal and the brake lever.

The waste collector and the air tube, although they are internally divided, externally form a single block and on the side of the collector is installed a door through which the deposited waste is removed.

To make the sweeping of a weeding plant, simply change the brooms with polyethylene bristles by brooms with steel bristles.

DESCRIPTION

The characterization of this document for a utility model patent is made by means of representative drawings of the self-propelled equipment for street sweeping and/or weeding, so that the equipment can be fully reproduced by proper technique, enabling full characterization of the functionality of the pleaded object.

From the drawn up figures expressing the best or preferred way to realize the product idealized herein, the descriptive part of the report is based, through a detailed and consecutive numeration, wherein this clarifies aspects that may be implied by the adopted representation, in order to clearly determine the protection herein intended.

These figures are merely illustrative and can vary, provided they do not escape of the originally claimed.

In this case:

DESCRIPTION

Figure 1:
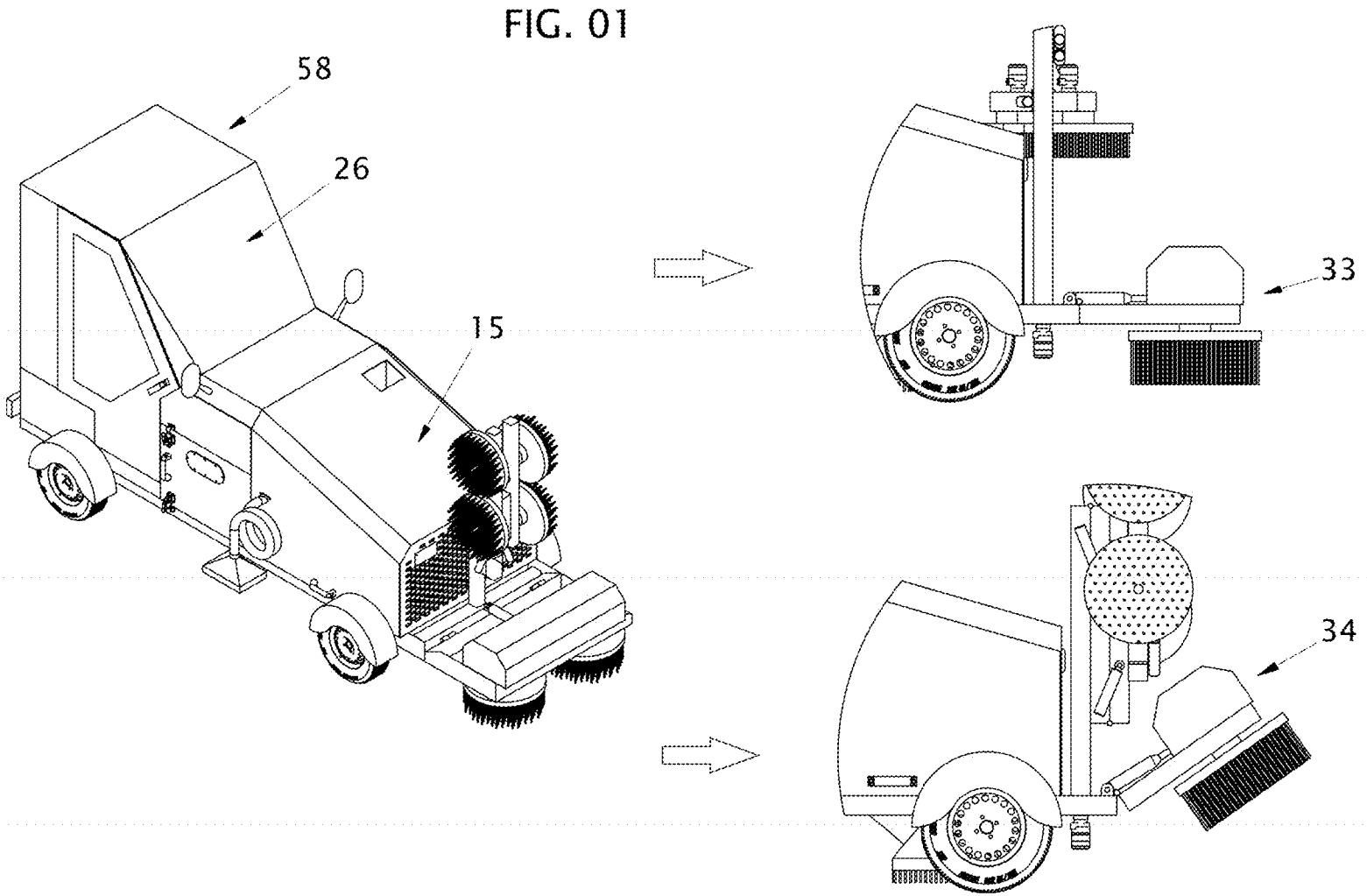
FIG. 1 illustrates a perspective of the equipment proposed and two details showing the front brooms extended and collected.
Figure 2:
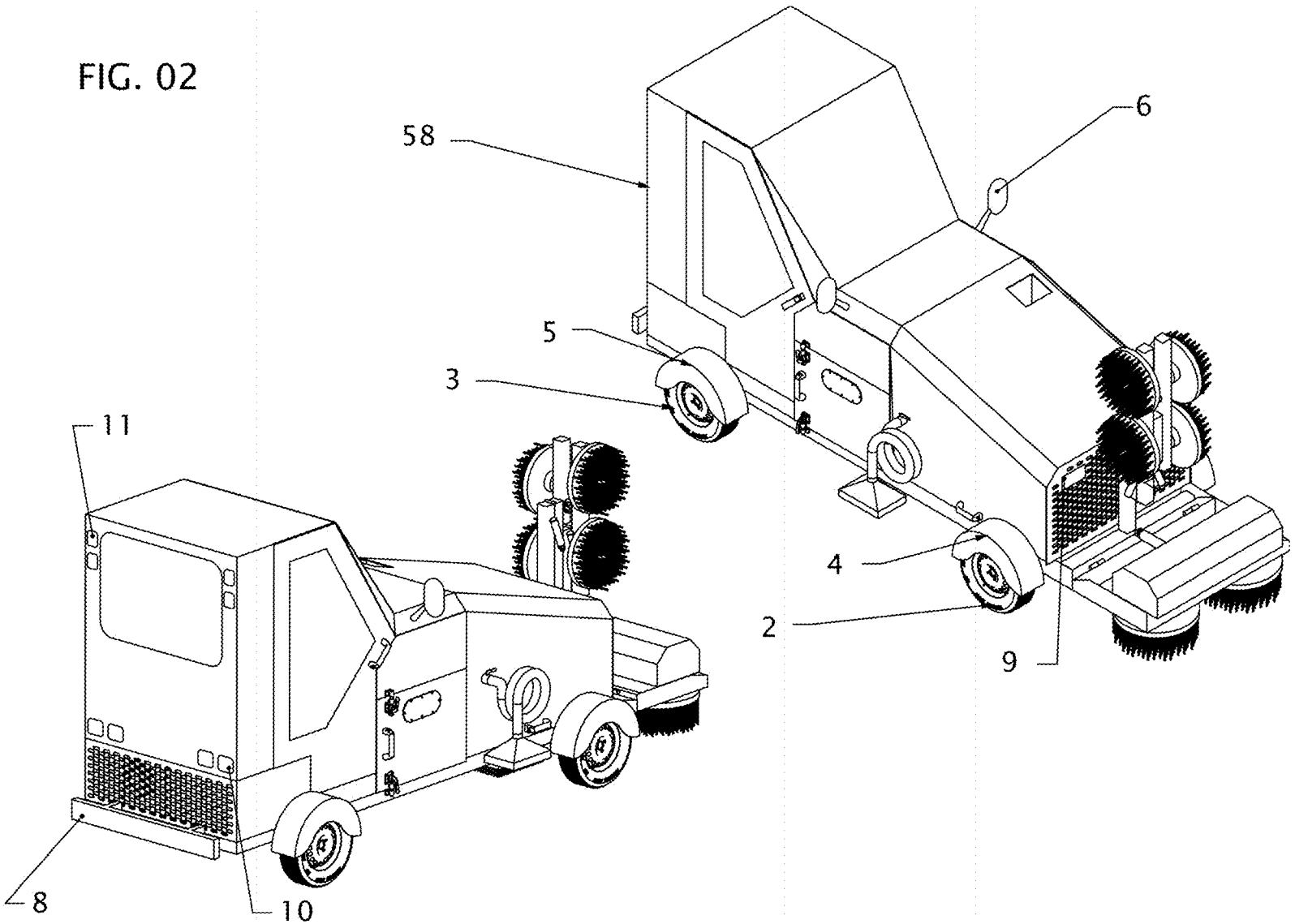
FIG. 2 shows a perspective of the equipment with emphasis on the front and another on the back part.
Figure 3:
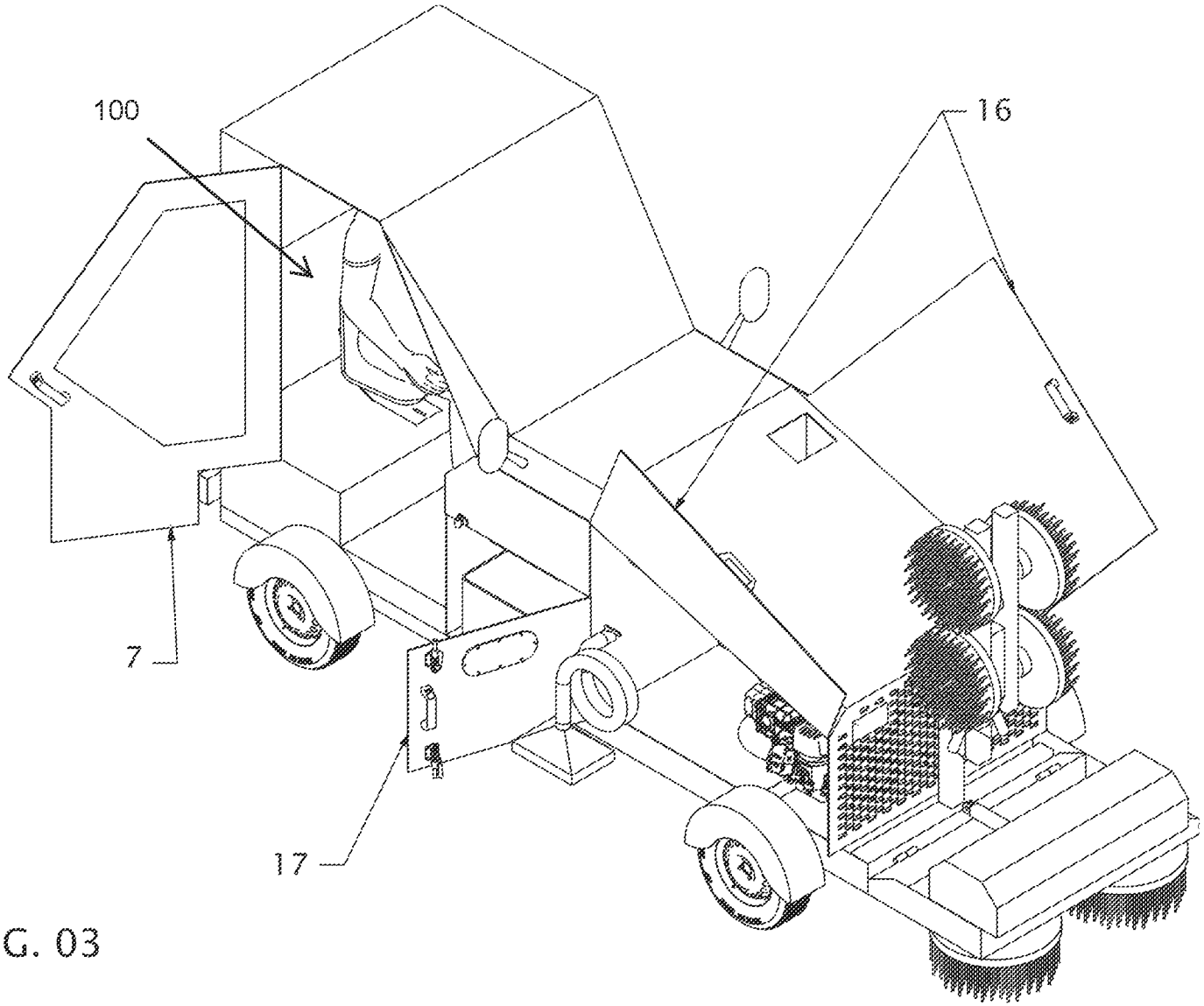
FIG. 3 shows a perspective with the door of the cabin and front fairing assembly opened.
Figure 4:
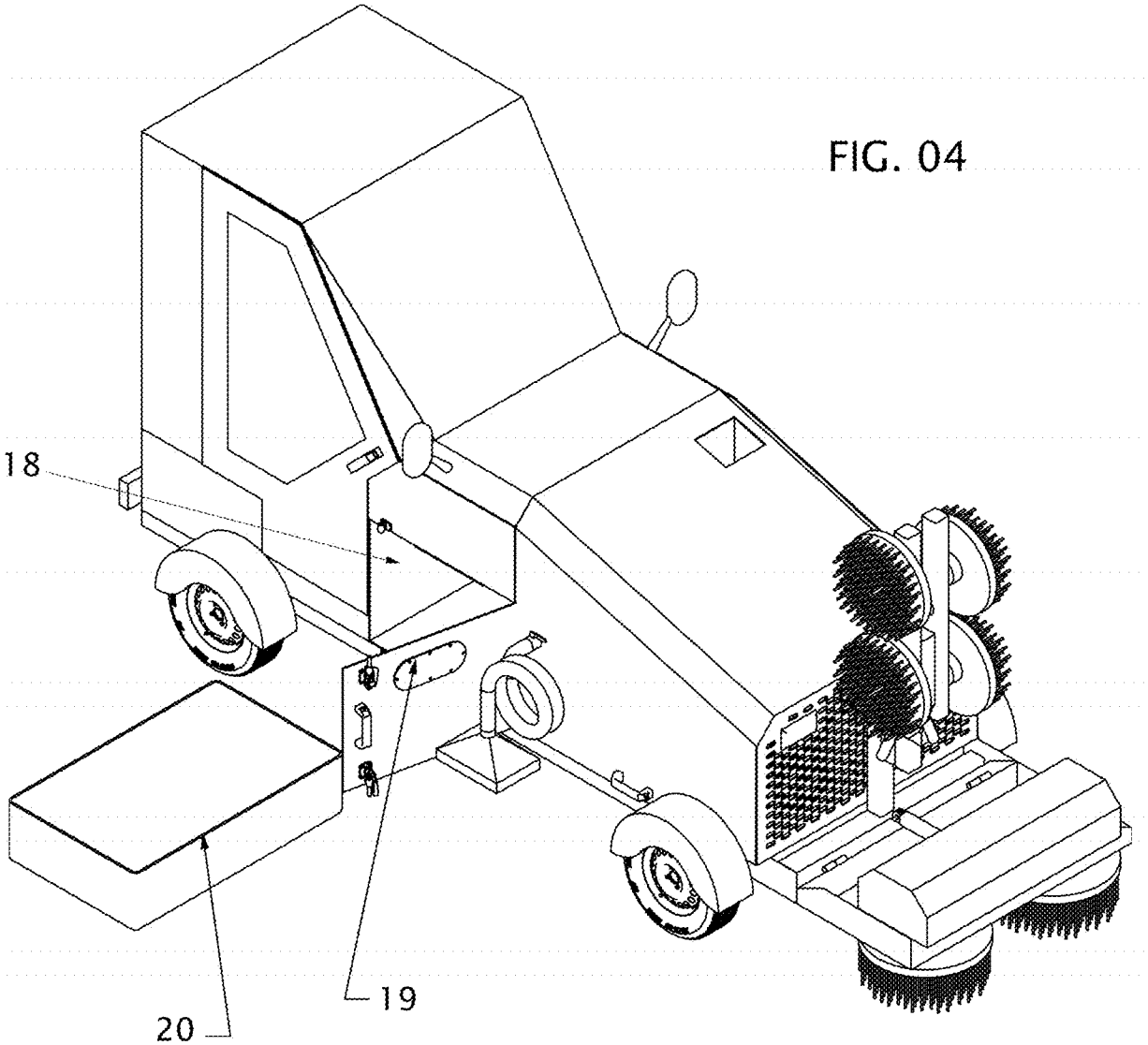
FIG. 4 shows a perspective of the equipment with debris box withdrawn.
Figure 5:
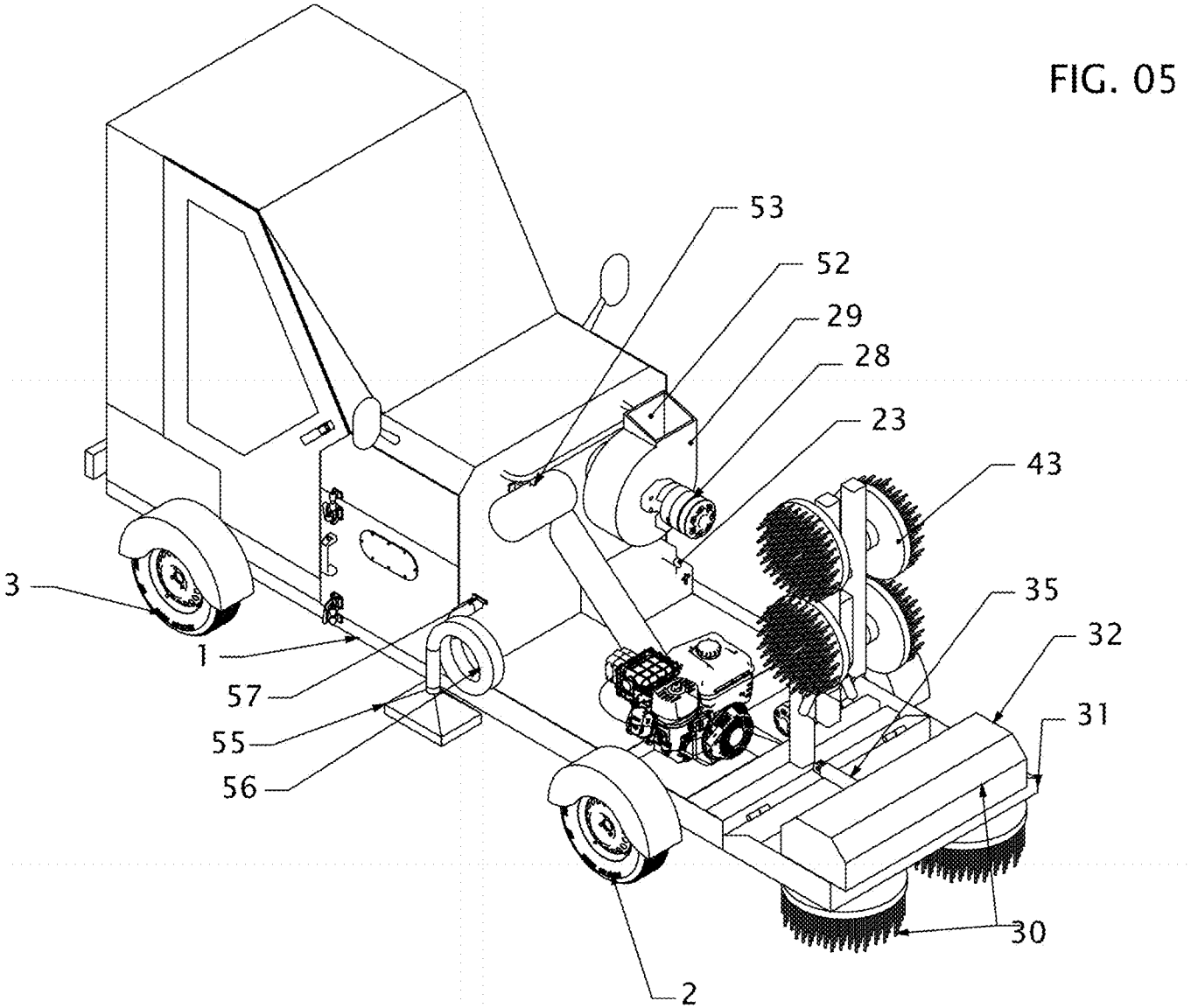
FIG. 5 shows a perspective of the equipment with the fairing assembly open to show the inner details.
Figure 6:
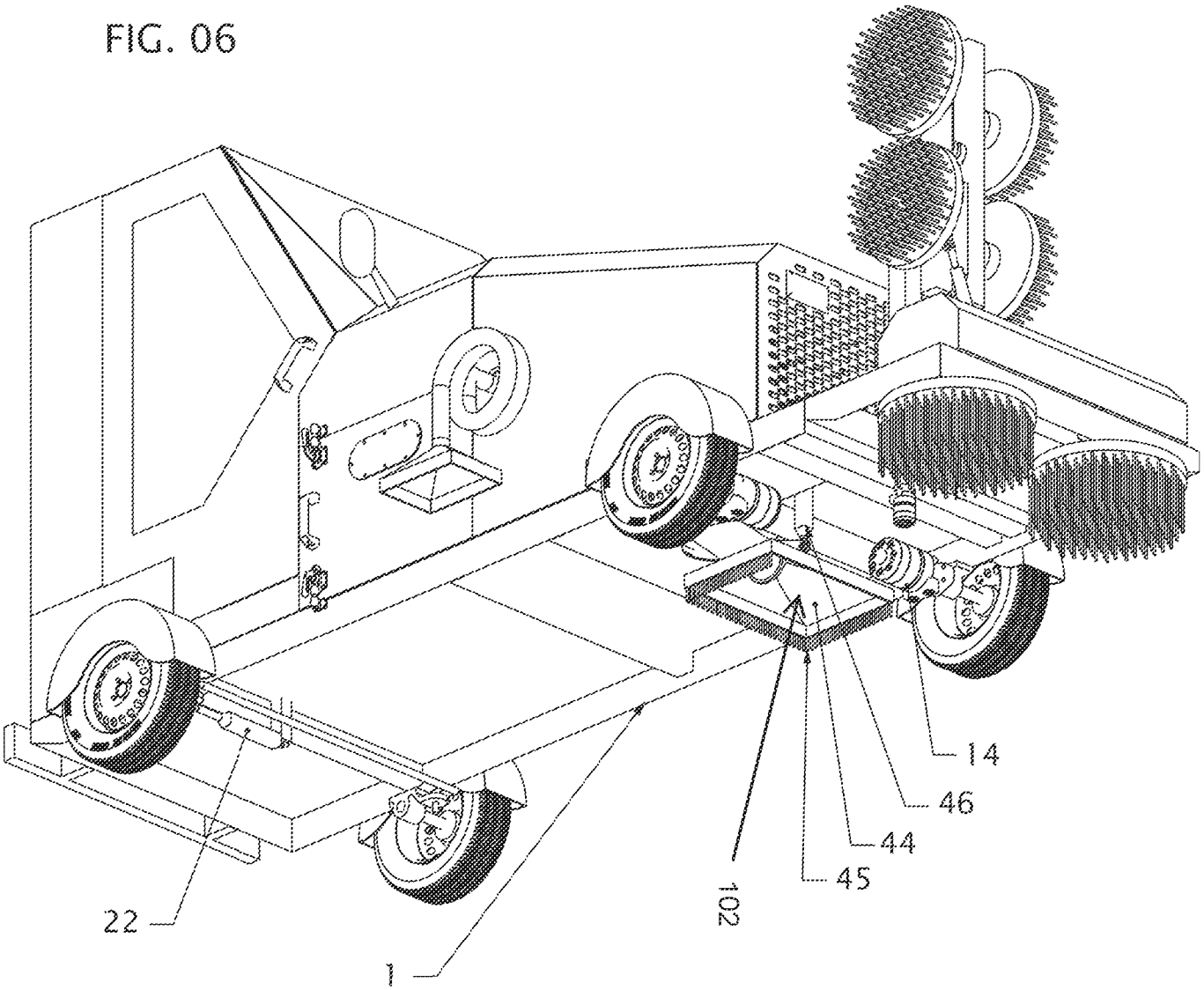
FIG. 6 shows a perspective of the equipment with views to the bottom.
Figure 7:
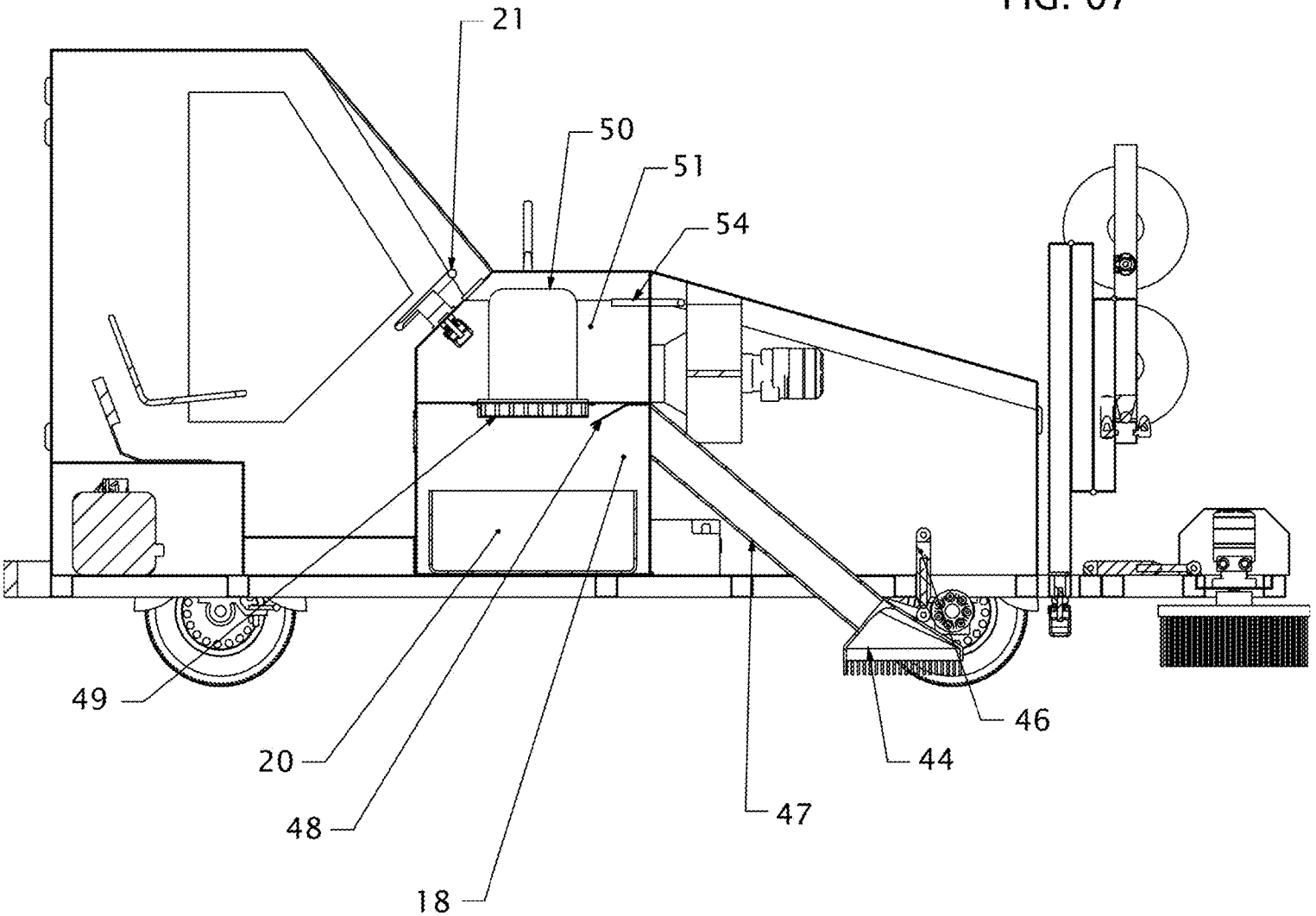
FIG. 7 shows a longitudinal cross-sectional view of the equipment for internal parts.
Figure 8:
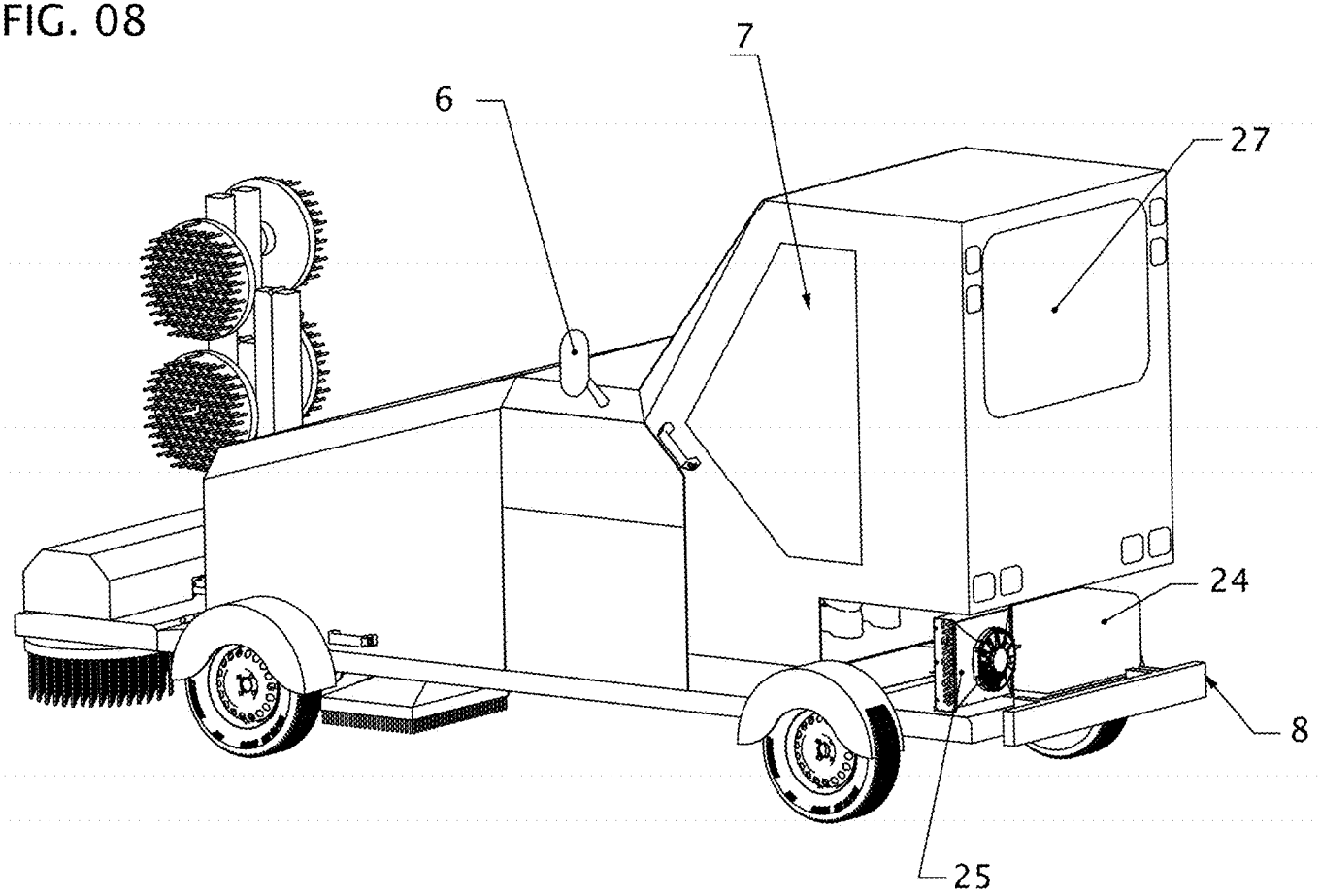
FIG. 8 shows a posterior perspective of the equipment with views to the reservoir and radiator for oil.
Figure 9:
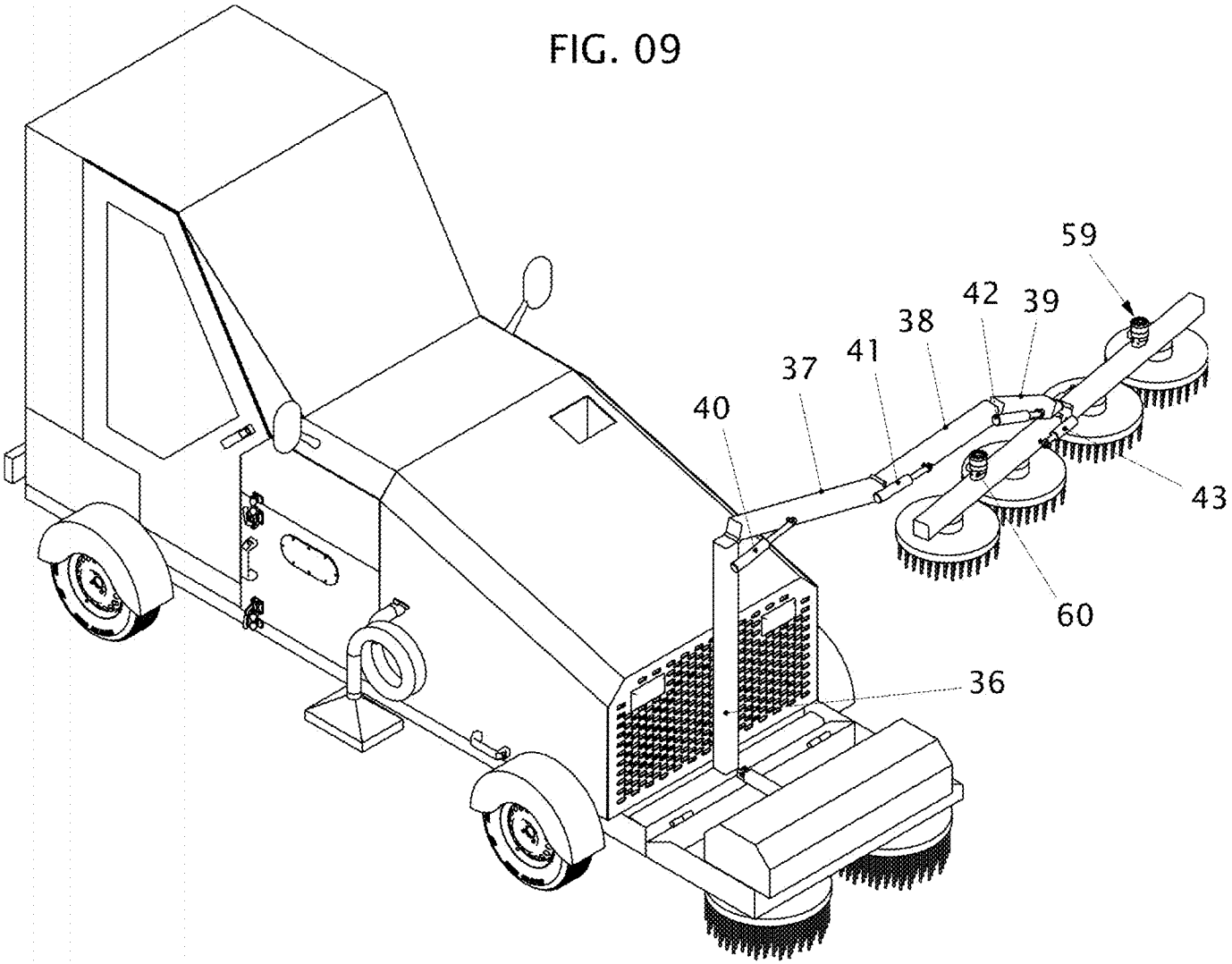
FIG. 9 shows a perspective of the equipment with the telescopic arm of the brushes extended.

A preferred embodiment of the equipment (vehicle) comprises a fixed chassis (1) having traction wheels (2) and driven wheels (3) with respective mudguards (4 and 5), cabin (58) with rear-view mirrors (6) access doors to the interior (100) of the cabin (7), rear bumper (8), headlights (9), lower rear (10) and upper (11) traffic lights, battery (23), front windows (26) and rear windows (27), being equipped with a combustion or electric motor (12) associated with a hydraulic pump (13), having hydraulic motors (14) connected to the front traction wheels (2) and responsible for moving the vehicle and a hydraulic motor (28) for the exhaust fan (29), wherein the hydraulic fluid is stored in the reservoir (24) adjacent the rear bumper (8) and is cooled by the radiator (25).

The vehicle has a fairing assembly (15) containing the access doors (16) to the mechanical assembly, a door (17) of the dirt chamber (18), provided with an inspection sight glass (19) for viewing the chamber, and the debris collection box (20) is arranged on this chamber (18).

The vehicle is maneuvered by steering (21) which drives the hydraulic cylinder (22) arranged close to the axis of the rear wheel (3).

On the front of the vehicle there are a pair of rotating brooms (30) which are integral with the hinged front chassis (31), provided with a protective fairing assembly (32), and such chassis (31) can be in the extended position (33) or the collected position (34) due to a piston (35) actuated from the cabin (58).

Behind the hinged front chassis (31) there is a rod (36) which supports a hinged bar (37, 38 and 39) by means of pistons (40, 41 and 42), responsible for moving a second assembly of brooms (43), in which this assembly of broom (43) is driven by motors (59 and 60) and can move at a 180° angle in front of the front brooms (30).

The front brooms pull downwardly and direct the debris into the pick-up (44), through the front opening (102), provided with a bristle edge forming a brush 45 with a front aperture, where this pick-up (44) has a hydraulic cylinder (46) to move it upwardly and downwardly so that the debris is sucked by means of piping (47), collide with a baffle (48) and are conveyed to the dirt chamber (18) to the debris collection box (20). The suctioning of the debris is achieved by means of the exhaust fan (29), wherein within the dirt chamber (18) there is a filtering system composed of a pre-filter (49) and a filter (50), equipped with cleaning filters (53) with cleaning tube (54), wherein the clean air passes into the clean suction chamber (51) and is demanded into the atmosphere by means of a clean air outlet duct (52).

A manual suction pickup (55) is disposed on the side of the vehicle, having a driving hose (56) and a manual directional valve (57) to suck hard-to-reach debris and drive them into the dirt chamber (18).

Figure 10:
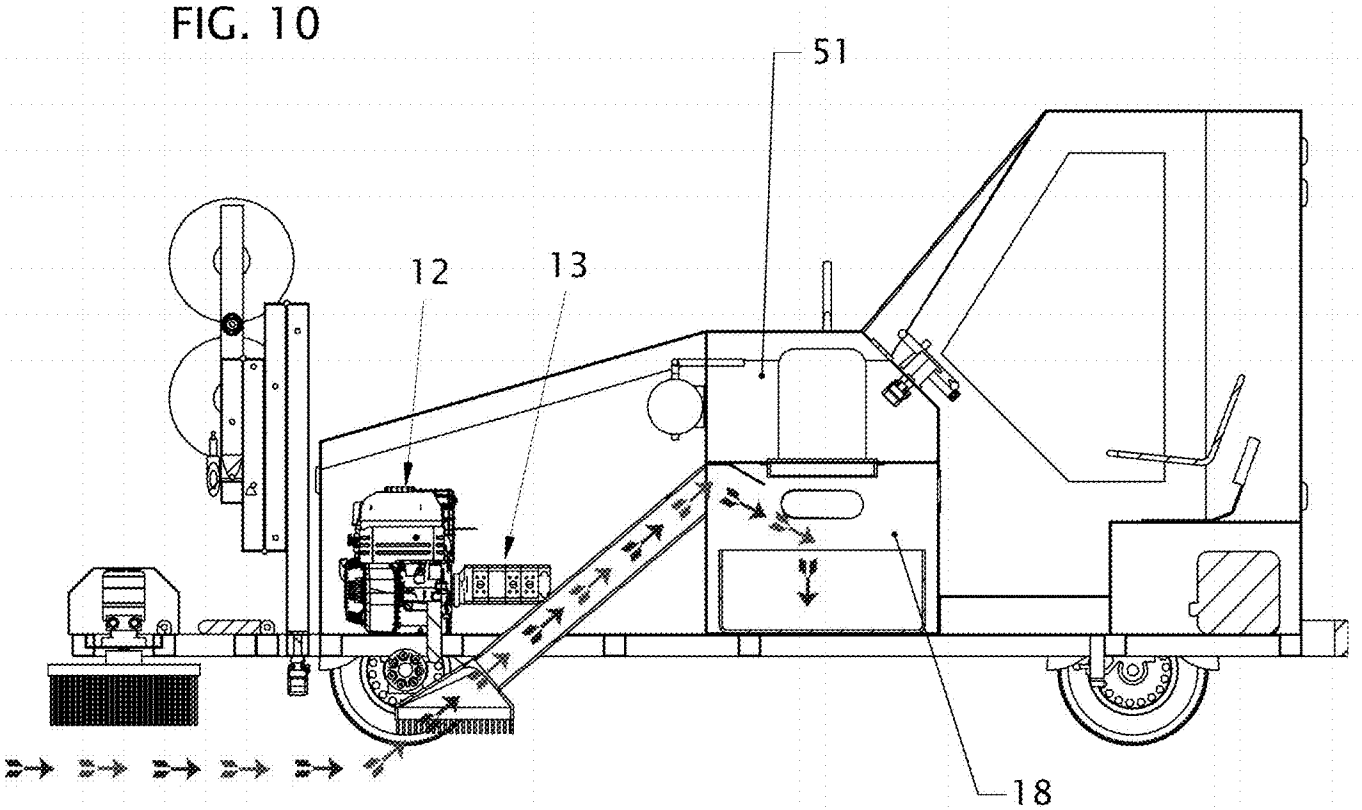
FIG. 10 shows a longitudinal section of the equipment with a view to the aspirated waste collection circuit.
Figure 11:
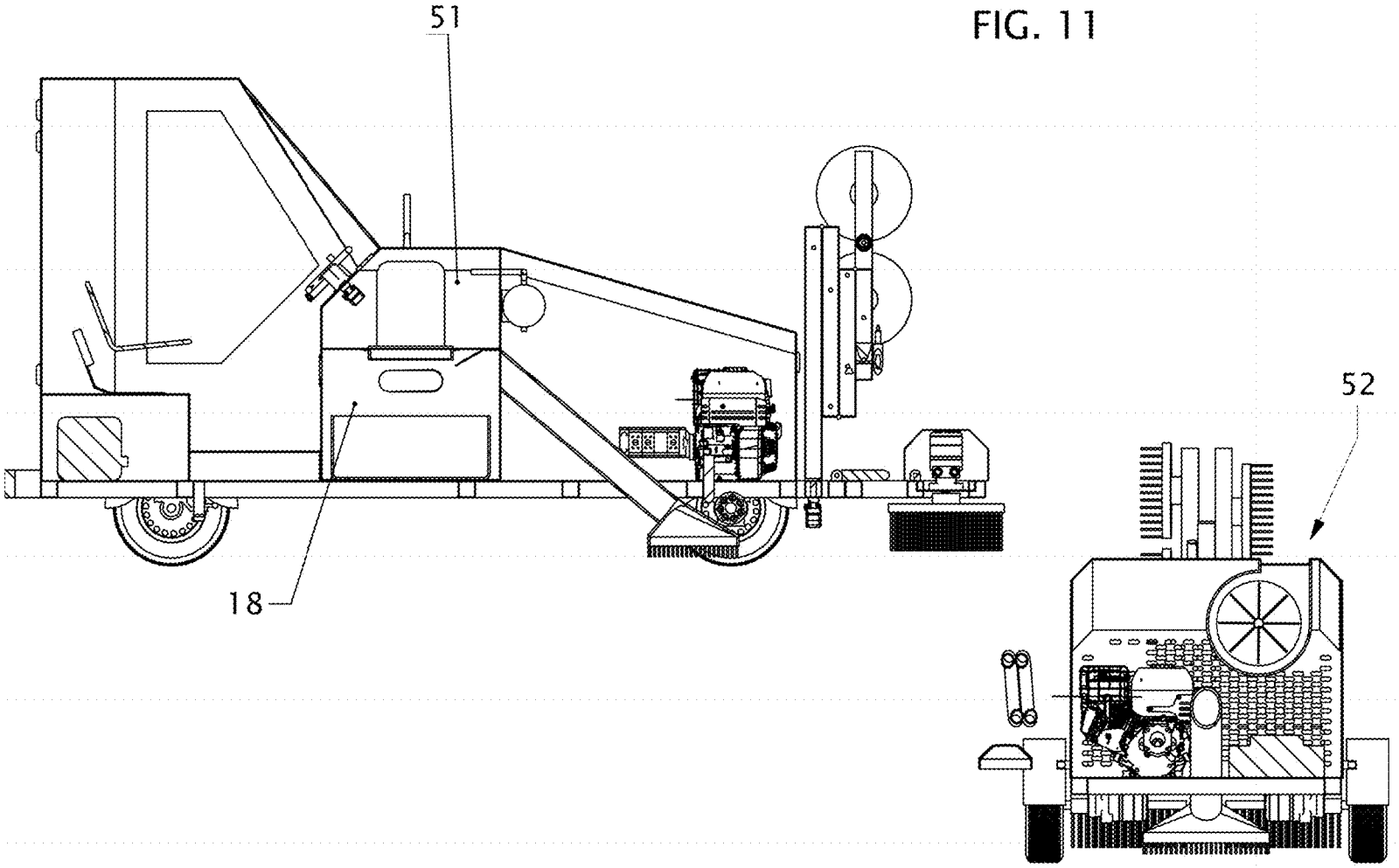
FIG. 11 shows a longitudinal section of the equipment with views of the clean air exit circuit.

FIGS. 10 and 11 show, respectively, the airflow to the dirty chamber (18) and the clean air flow from the clean suction chamber (51) to the outlet (52).

The invention claimed is:

1. A self-propelled equipment for street sweeping and/or weeding, the equipment comprising:

a fixed chassis with a plurality of traction wheels and driven wheels with respective mudguards, the plurality of traction wheels including front traction wheels and rear traction wheels;

a cabin with rear-view mirrors, the cabin being affixed to the fixed chassis;

a plurality of access doors to an interior of the cabin;

a rear bumper at a rear of the cabin; rear upper and lower traffic lights at the rear of the cabin;

a battery at the fixed chassis;

a plurality of front and rear windows at the cabin;

a combustion or electric motor associated with a hydraulic pump connected to the front traction wheels and configured to cause the vehicle to move;

an exhaust fan comprising a hydraulic motor;

a rear bumper;

a reservoir next to the rear bumper, hydraulic fluid being stored in the reservoir;

a radiator configured to cool the hydraulic fluid;

a hinged front chassis connected to the fixed chassis, the hinged front chassis configured to be in an extended position or a collected position by a first piston actuated from the cabin;

a pair of rotating front brooms on a front of the equipment, the pair of rotating brooms being integral with the hinged front chassis;

a rod configured to support a hinged bar by a plurality of second pistons, the rod being disposed proximal to the hinged front chassis in relation to the cabin, the plurality of second pistons being configured to move another assembly of brooms that are driven by motors and configured to move at a 180° angle in front of the pair of rotating front brooms;

a fairing assembly disposed on the fixed chassis between the cabin and the hinged front chassis;

a plurality of headlamps disposed on the fairing assembly;

a debris pick-up provided with a a bristle brush, the debris pick-up having a front opening, a hydraulic cylinder, a tubing, and a baffle;

a dirt chamber having a door, the door of the dirt chamber being provided with an inspection sight glass a debris collection box being disposed on the dirt chamber, a pre-filter and a filter being disposed within the dirt chamber;

a tube;

a clean suction chamber;

a clean air outlet duct, clean air passing into the clean suction chamber from the tube and output to the environment by the clean air outlet duct; and having a manual suction pickup disposed at a side of the equipment, the manual suction pickup having a driving hose and a manual directional valve.

* * * * *